US008047775B2

(12) United States Patent
Barnikel et al.

(10) Patent No.: US 8,047,775 B2
(45) Date of Patent: Nov. 1, 2011

(54) LAYER SYSTEM FOR A COMPONENT COMPRISING A THERMAL BARRIER COATING AND METALLIC EROSION-RESISTANT LAYER, PRODUCTION PROCESS AND METHOD FOR OPERATING A STEAM TURBINE

(75) Inventors: Jochen Barnikel, Mülheim an der Ruhr (DE); Friedhelm Schmitz, Dinslaken (DE)

(73) Assignee: Siemens Aktiengesellschaft, Munich (DE)

( * ) Notice: Subject to any disclaimer, the term of this patent is extended or adjusted under 35 U.S.C. 154(b) by 991 days.

(21) Appl. No.: 11/922,149

(22) PCT Filed: Mar. 17, 2006

(86) PCT No.: PCT/EP2006/060835

§ 371 (c)(1), (2), (4) Date: Dec. 13, 2007

(87) PCT Pub. No.: WO2006/133980

PCT Pub. Date: Dec. 21, 2006

(65) Prior Publication Data

US 2009/0053069 A1 Feb. 26, 2009

(30) Foreign Application Priority Data

Jun. 13, 2005 (EP) ..... 05012633

(51) Int. Cl.
*F01D 25/00* (2006.01)

(52) U.S. Cl. ..... 415/200; 416/241 R

(58) Field of Classification Search ..... 415/200; 428/668, 680, 681; 148/307, 312, 313, 325, 148/331, 425, 428, 429; 416/241 R
See application file for complete search history.

(56) References Cited

U.S. PATENT DOCUMENTS

| | | | | |
|---|---|---|---|---|
| 4,005,989 | A | 2/1977 | Preston | |
| 4,101,713 | A | 7/1978 | Hirsch et al. | |
| 4,405,284 | A | 9/1983 | Albrecht et al. | |
| 4,497,669 | A * | 2/1985 | Wang et al. | 75/232 |
| 4,585,481 | A | 4/1986 | Gupta et al. | |
| 4,787,945 | A * | 11/1988 | Smith et al. | 148/428 |
| 5,268,238 | A * | 12/1993 | Czech et al. | 428/678 |
| 5,350,599 | A | 9/1994 | Rigney et al. | |
| 5,683,226 | A | 11/1997 | Clark et al. | |
| 5,740,515 | A | 4/1998 | Beele | |
| 6,682,780 | B2 * | 1/2004 | Tzatzov et al. | 427/383.1 |
| 2003/0152814 | A1 | 8/2003 | Gupta et al. | |

FOREIGN PATENT DOCUMENTS

| | | |
|---|---|---|
| DE | 195 35 227 A1 | 3/1997 |
| EP | 0 783 043 A1 | 7/1997 |
| EP | 1 029 104 B1 | 8/2000 |
| EP | 1 029 115 B1 | 8/2000 |
| EP | 1 283 278 A2 | 2/2003 |
| EP | 1 541 808 A1 | 6/2005 |
| EP | 1 541 810 A1 | 6/2005 |
| WO | WO 00/70190 A1 | 11/2000 |

* cited by examiner

*Primary Examiner* — Ninh H Nguyen

(57) ABSTRACT

There are described components of a steam turbine, comprising a thermally insulating layer and a metallic anti-erosion layer on said thermally insulating layer. The anti-erosion layer is provided with the same material as the metallic connecting layer.

20 Claims, 4 Drawing Sheets

LAYER SYSTEM FOR A COMPONENT COMPRISING A THERMAL BARRIER COATING AND METALLIC EROSION-RESISTANT LAYER, PRODUCTION PROCESS AND METHOD FOR OPERATING A STEAM TURBINE

CROSS REFERENCE TO RELATED APPLICATIONS

This application is the US National Stage of International Application No. PCT/EP2006/060835, filed Mar. 17, 2006 and claims the benefit thereof. The International Application claims the benefits of European Patent Office application No. 05012633.3 filed Jun. 13, 2005, both of the applications are incorporated by reference herein in their entirety.

FIELD OF INVENTION

The invention relates to a component having a thermal barrier coating and a metallic erosion-resistant, to a production process and to a method for operating a steam turbine.

BACKGROUND OF INVENTION

Thermal barrier coatings which are applied to components are known from the field of gas turbines, as described for example in EP 1 029 115.

Thermal barrier coatings enable components to be used at higher temperatures than those permitted by the base material, or allow the service life to be extended.

Known base materials (substrates) for gas turbines allow temperatures of use of at most 1000° C. to 1100° C., whereas a coating with a thermal barrier coating allows temperatures of use of up to 1350° C.

The temperatures of use of components in a steam turbine are much lower, and consequently these demands are not imposed in this application.

It is known from EP 1 029 104 A to apply a ceramic erosion-resistant layer to a ceramic thermal barrier coating of a gas turbine blade or vane.

It is known from DE 195 35 227 A1 to provide a thermal barrier coating in a steam turbine in order to allow the use of materials which have worse mechanical properties but are less expensive for the substrate to which the thermal barrier coating is applied.

U.S. Pat. No. 5,350,599 discloses an erosion-resistant ceramic thermal barrier coating.

US 2003/0152814 A1 discloses a thermal barrier coating system comprising a substrate made from a superalloy, an aluminum oxide layer on the substrate and a ceramic as outer ceramic thermal barrier coating.

EP 0 783 043 A1 discloses an erosion-resistant layer consisting of aluminum oxide or silicon carbide on a ceramic thermal barrier coating.

U.S. Pat. No. 5,683,226 discloses a component of a steam turbine with improved resistance to erosion.

U.S. Pat. No. 4,405,284 discloses an outer metallic layer which is considerably more porous than the underlying ceramic thermal barrier coating.

In its discussion of the prior art, EP 0 783 043 A1 discloses the formation of an erosion-resistant coating in two layers, specifically comprising an inner metallic layer and an outer ceramic layer.

U.S. Pat. No. 5,740,515 discloses a ceramic thermal barrier coating to which an outer, hard ceramic silicide coating has been applied.

WO 00/70190 discloses a component wherein an outer metallic layer is applied, this layer containing aluminum in order to increase the oxidation resistance of the component.

The thermal barrier coating is strongly eroded on account of impurities in a medium and/or high flow velocities of the flowing medium which flows past components having a thermal barrier coating.

SUMMARY OF INVENTION

Therefore, it is an object of the invention to provide a component, a process for producing the component and a suitable use of the layer system which overcomes this problem.

The object is achieved by a component and a method as claimed in independent claims.

The subclaims list further advantageous configurations of the components according to the invention.

The measures listed in the subclaims can be combined with one another in advantageous ways.

In particular in the case of components of turbines which are exposed to hot fluids for driving purposes, scaling often leads to mechanical impact of detached scale particles on a brittle ceramic layer, which could lead to material breaking off, i.e. to erosion. Although the ceramic layer is designed to withstand thermal shocks, it is susceptible to locally very limited occurrences of mechanical stresses, since a thermal shock has a more widespread effect on the overall layer.

Therefore, a metallic erosion-resistant layer is particularly advantageous, since it is elastically and plastically deformable on account of its ductility.

The thermal barrier coating does not necessarily serve only to shift the range of use temperatures upward, but rather is also advantageously used to reduce and/or make more even the thermal expansion caused by the temperature differences which are produced and/or present at the component. It is in this way possible to avoid or at least reduce thermomechanical stresses.

BRIEF DESCRIPTION OF THE DRAWINGS

Exemplary embodiments are illustrated in the figures, in which.

DETAILED DESCRIPTION OF INVENTION

Figure 1:
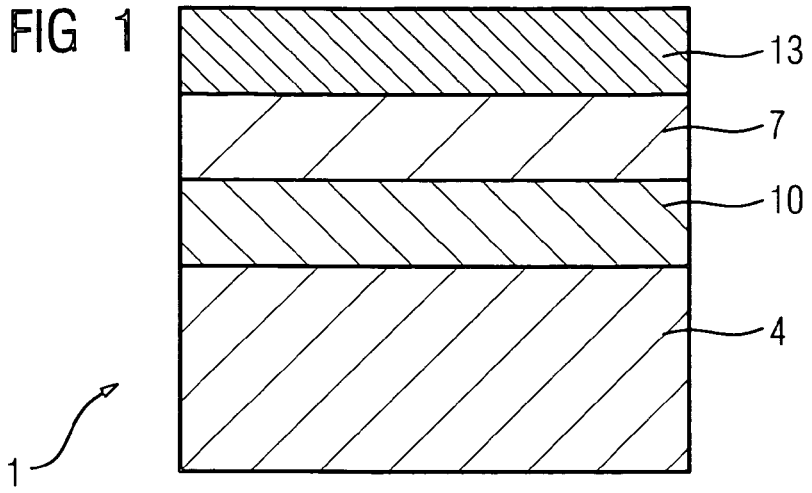
FIG. 1 shows possible arrangements of a thermal barrier coating according to the invention on a component.

FIG. 1 shows a first exemplary embodiment of a layer system 1 formed in accordance with the invention for a component. In the text which follows, the terms layer system 1 and component are used synonymously when the component includes the layer system 1.

The component 1 is preferably a component of a gas or steam turbine 300, 303 (FIG. 4), in particular a steam inflow region 333 of a steam turbine 300, a turbine blade or vane 342, 354, 357 (FIG. 4) or a housing part 334, 335, 366 (FIGS. 4, 5) and comprises a substrate 4 (supporting structure) and a thermal barrier coating 7 applied to the substrate, as well as an outer metallic erosion-resistant layer 13 on the thermal barrier coating 7. At least one metallic bonding layer 10 is arranged between the substrate 4 and the thermal barrier coating 7. The bonding layer 10 is used to protect the substrate 4 from corrosion and/or oxidation and/or to improve the bonding of the thermal barrier coating 7 to the substrate 4. This applies in particular if the thermal barrier coating 7 consists of ceramic and the substrate 4 consists of a metal.

The erosion-resistant layer 13 consists of a metal or a metal alloy and protects the component from erosion and/or wear, as is the case in particular for steam turbines 300, 303 (FIG. 4), which are subject to scaling, and in which mean flow velocities of approximately 50 m/s (i.e. 20 m/s-100 m/s) and pressures from 350 to 400 bar occur.

The outer metallic erosion-resistant layer 13 (=outermost layer) is preferably formed to be denser than the thermal barrier coating 7.

In this context, the term denser means that the porosity of the outer metallic erosion-resistant layer 13 is in absolute terms at least 1%, in particular at least 3%, higher than that of the thermal barrier coating 7 (for example $\rho(7)=90\%$, i.e. $\rho(13)\geqq 91\%$, in particular$\geqq 93\%$)

The density of the thermal barrier coating 7 is preferably 80%-95% of the theoretical density, while the density $\rho$ of the metallic erosion-resistant layer 13 is preferably at least 96%, preferably 98% of the theoretical density.

The term metal is to be understood as encompassing not just elemental metals but also alloys, solid solutions or intermetallic compounds.

According to the invention, the bonding layer 10 and the erosion-resistant layer 13 have an identical or similar composition.

An identical composition means that the two layers 10, 13 contain the same elements in the same amounts, preferably comprising an MCrAlX alloy or SC 21, SC 23 or SC 24. The preferred use of an identical composition for the erosion-resistant layer 13 simplifies procurement and also significantly improves the corrosion properties of the substrate 4.

A similar composition means that the two layers 10, 13 contain the same elements but in slightly differing proportions, i.e. differences of at most 3% per element (for example layer 10 may have a chromium content of 30%, in which case the layer 13 may have a chromium content from at least 27% (30-3) to at most 33% (30+3)) and that up to 1 wt % of at least one further element may be present.

SC 21 consists of (in wt %) 29%-31% nickel, 27%-29% chromium, 7%-8% aluminum, 0.5%-0.7% yttrium, 0.3%-0.7% silicon, remainder cobalt.

SC 23 consists of (in wt %) 11%-13% cobalt, 20%-22% chromium, 10.5%-11.5% aluminum, 0.3%-0.5% yttrium, 1.5%-2.5% rhenium, remainder nickel.

SC 24 consists of (in wt %) 24%-26% cobalt, 16%-18% chromium, 9.5%-11% aluminum, 0.3%-0.5% yttrium, 1.0%-1.8% rhenium, remainder nickel.

The wear-/erosion-resistant layer 13 preferably consists of alloys based on iron, chromium, nickel and/or cobalt or for example NiCr 80/20 or NiCrSiB with admixtures of boron (B) and silicon (Si) or NiAl (for example: Ni: 95 wt %, Al 5 wt %).

In particular, a metallic erosion-resistant layer 13 can be used for steam turbines 300, 303, since the use temperatures in steam turbines at the steam inflow region 333 are at most 450° C., 550° C., 650° C., 750° C. or 850° C.

It is preferable to use a temperature of 750° C.

For these temperature ranges, there are sufficient metallic layers which have a sufficiently high resistance to erosion over the service life of the component 1 combined, at the same time, with a good resistance to oxidation.

Metallic erosion-resistant layers 13 in gas turbines on a ceramic thermal barrier coating 7 within the first stage of the turbine or within the combustion chamber are not appropriate, since metallic erosion-resistant layers 13 as an outer layer are unable to withstand the use temperatures of up to 1350° C.

The bonding layer 10 for protecting a substrate 4 from corrosion and oxidation at a high temperature includes, for example, substantially the following elements (details of the contents in percent by weight):

11.5 to 20.0 wt % chromium,
0.3 to 1.5 wt % silicon,
0.0 to 1.0 wt % aluminum,
0.0 to 0.7 wt % yttrium and/or at least one equivalent metal selected from the group consisting of scandium and the rare earth elements,
remainder iron, cobalt and/or nickel as well as manufacturing-related impurities.

In particular the metallic bonding layer 10 consists of 12.5 to 14.0 wt % chromium,
0.5 to 1.0 wt % silicon,
0.1 to 0.5 wt % aluminum,
0.0 to 0.7 wt % yttrium and/or at least one equivalent metal selected from the group consisting of scandium and the rare earth elements,
remainder iron and/or cobalt and/or nickel as well as manufacturing-related impurities.

It is preferable if the remainder of these two bonding layers 10 is iron alone.

The composition of the bonding layer 10 based on iron has particularly good properties, with the result that the bonding layer 10 is eminently suitable for application to ferritic substrates 4.

The coefficients of thermal expansion of substrate 4 and bonding layer 10 can be very well matched to one another (up to 10% difference) or may even be identical, so that no thermally induced stresses are built up between substrate 4 and bonding layer 10 (thermal mismatch), which could cause the bonding layer 10 to flake off.

This is particularly important since in the case of ferritic materials, it is often the case that there is no heat treatment carried out for diffusion bonding, but rather the bonding layer 10 (ferritic) is bonded to the substrate 4 mostly or solely through adhesion.

The composition of the outer erosion-resistant layer 13 is selected in such a way as to have a high ductility. In this context, the term high ductility means an elongation at break of 5% (an elongation of 5% leads to the formation of cracks) at the temperature of use.

An erosion-resistant layer 13 having a ductility of this level may be present directly on a substrate 4 or on a ceramic thermal barrier coating 7, in which case the composition of the bonding layer 10 is then no longer of importance.

The thermal barrier coating 7 is in particular a ceramic layer which for example consists at least in part of zirconium oxide (partially stabilized or fully stabilized by yttrium oxide and/or magnesium oxide) and/or at least in part of titanium oxide and is, for example, thicker than 0.1 mm. By way of example, it is possible to use thermal barrier coatings 7 consisting 100% of either zirconium oxide or titanium oxide.

The ceramic layer 7 can be applied by means of known coating processes, such as atmospheric plasma spraying (APS), vacuum plasma spraying (VPS), low-pressure plasma spraying (LPPS) and by chemical or physical coating methods (CVD, PVD).

The substrate 4 is preferably a steel or other iron-base alloy (for example 1% CrMoV or 10-12% chromium steels) or a nickel- or cobalt-base superalloy.

In particular, the substrate 4 is a ferritic base alloy, a steel or nickel- or cobalt-base superalloy, in particular a 1% CrMoV steel or a 10 to 12% chromium steel.

Further advantageous ferritic substrates 4 of the layer system 1 consist of a 1% to 2% Cr steel for shafts (309, FIG. 4):
such as for example 30CrMoNiV5-11 or 23CrMoNiWV8-8, 1% to 2% Cr steel for housings (for example 335, FIG. 4):
G17CrMoV5-10 or G17CrMo9-10, 10% Cr steel for shafts (309, FIG. 4):
X12CrMoWVNbN10-1-1, 10% Cr steel for housings (for example 335, FIG. 4):
GX12CrMoWVNbN10-1-1 or GX12CrMoVNbN9-1.

To optimize the efficiency of the thermal barrier coating 7, the thermal barrier coating 7 at least in part has a certain open and/or closed porosity.

It is preferable for the erosion-resistant layer 13 to have a higher density than the thermal barrier coating 7, so that it (13) has a higher resistance to erosion.

The metallic erosion-resistant layer 13 has a very low porosity and in particular has a relatively low roughness, so as to provide a good resistance to removal of material through erosion.

The lower porosity and roughness of the metallic erosion-resistant layer can be achieved using varying techniques:

1. Use of a spray powder with the smallest possible grain size during the thermal spraying of the erosion-resistant layer 13,
2. densification of the outer metallic erosion-resistant layer 13 after spraying by a blasting operation, for example by blasting with glass beads or steel grit or other mechanical densification or smoothing processes (rolling, vibratory finishing),
3. closing of the open pores by penetration agents,
4. heat treatment of the entire system,
5. fusion or remelting of the top layer or of the entire metallic erosion-resistant layer.

By contrast, the bonding layer 10, which is located between the substrate and the thermal barrier coating, is implemented in such a way as to have a sufficiently high roughness with undercuts, in order to effect secure bonding of the thermal barrier coating to the bonding layer 10. In this case, the powder used during the spraying operation can be significantly coarser than that used for the erosion-resistant layer 13.

Figure 2:
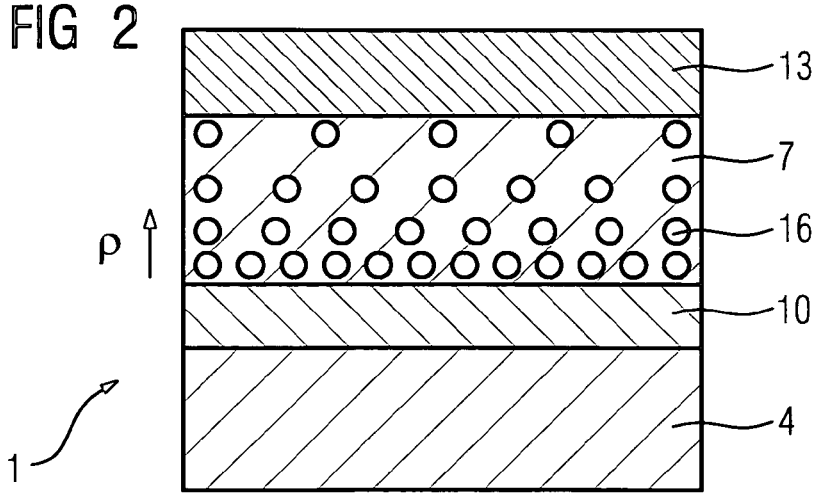
FIGS. 2, 3 show a porosity gradient within the thermal barrier coating of a component formed in accordance with the invention.

FIG. 2 shows a porous thermal barrier coating 7 with a porosity gradient.

Pores 16 are present in the thermal barrier coating 7. The density ρ of the thermal barrier coating 7 increases in the direction of an outer surface.

Therefore, the layer 7 can be used as a thermal barrier in the region where the porosity is greater and if appropriate can also be used to protect against erosion in the region where the porosity is lower. Therefore, there is preferably a greater porosity toward the bonding layer 10 than in the region of an outer surface or the contact surface with the erosion-resistant layer 13.

Figure 3:
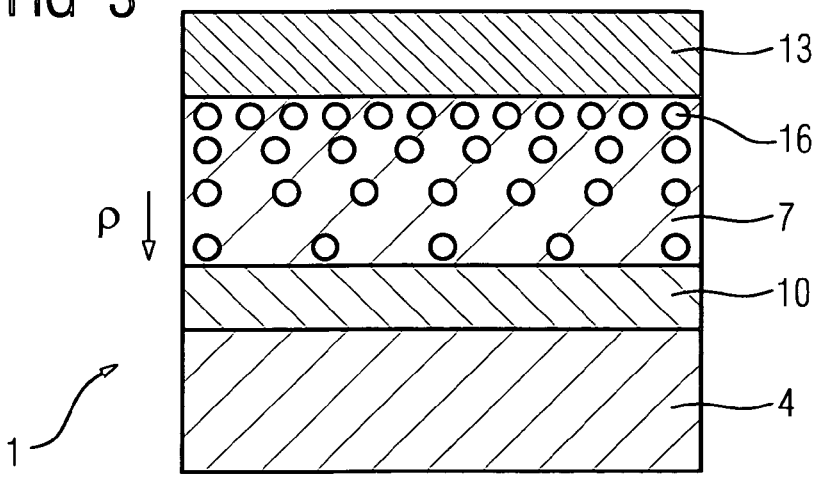

In FIG. 3, the gradient of the density ρ of the thermal barrier coating 7 is opposite to that shown in FIG. 2.

The erosion-resistant layer 13 is preferably only applied locally, and is preferably applied to the component 1 where the angle at which eroding particles impinge on the component 1 is between 60° and 120°, preferably between 70° and 110° or preferably around 80° and 100°. It is particularly useful to coat the locations where the eroding particles impinge at an angle of 90°+/−2°. A metallic erosion-resistant layer 13 offers the best protection against erosion with this virtually perpendicular impingement of eroding particles on the surface of a component 1. The perpendicular to the surface of the component 1 constitutes the 90° axis.

Figure 4:
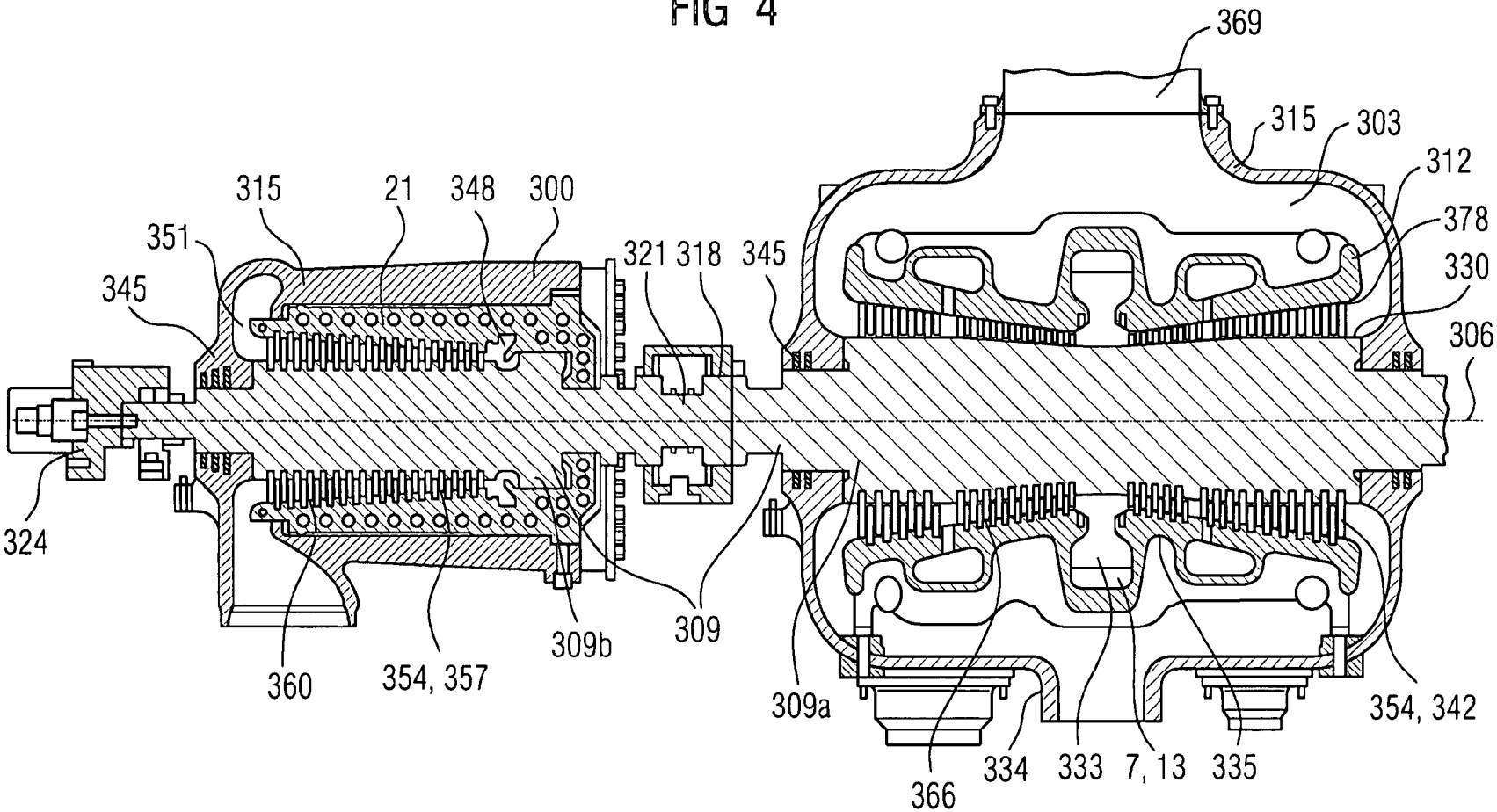
FIGS. 4, 5 show a steam turbine.

FIG. 4 illustrates, by way of example, a steam turbine 300, 303 with a turbine shaft 309 extending along an axis of rotation 306.

The steam turbine has a high-pressure part-turbine 300 and an intermediate-pressure part-turbine 303, each having an inner housing 312 and an outer housing 315 surrounding the inner housing. The high-pressure part-turbine 300 is, for example, of pot-like design. The intermediate-pressure part-turbine 303 is of two-flow design. It is also possible for the intermediate-pressure part-turbine 303 to be of single-flow design. Along the axis of rotation 306, a bearing 318 is arranged between the high-pressure part-turbine 300 and the intermediate-pressure part-turbine 303, the turbine shaft 309 having a bearing region 321 in the bearing 318. The turbine shaft 309 is mounted on a further bearing 324 next to the high-pressure part-turbine 300. In the region of this bearing 324, the high-pressure part-turbine 300 has a shaft seal 345. The turbine shaft 309 is sealed with respect to the outer housing 315 of the intermediate-pressure part-turbine 303 by two further shaft seals 345. Between a high-pressure steam inflow region 348 and a steam outlet region 351, the turbine shaft 309 in the high-pressure part-turbine 300 has the high-pressure rotor blading 354, 357. This high-pressure rotor blading 354, 357, together with the associated rotor blades (not shown in more detail), constitutes a first blading region 360. The intermediate-pressure part-turbine 303 has a central steam inflow region 333. Assigned to the steam inflow region 333, the turbine shaft 309 has a radially symmetrical shaft shield 363, a cover plate, on the one hand for dividing the flow of steam between the two flows of the intermediate-pressure part-turbine 303 and also for preventing direct contact between the hot steam and the turbine shaft 309. In the intermediate-pressure part-turbine 303, the turbine shaft 309 has a second blading region 366 having the intermediate-pressure rotor blades 354, 342. The hot steam flowing through the second blading region 366 flows out of the intermediate-pressure part-turbine 303 from an outflow connection piece 369 to a low-pressure part-turbine (not shown) which is connected downstream in terms of flow.

The turbine shaft 309 is composed of two turbine part-shafts 309*a* and 309*b*, which are fixedly connected to one another in the region of the bearing 318.

In particular, the steam inflow region 333 has a thermal barrier coating 7 and an erosion-resistant layer 13.

Figure 5:
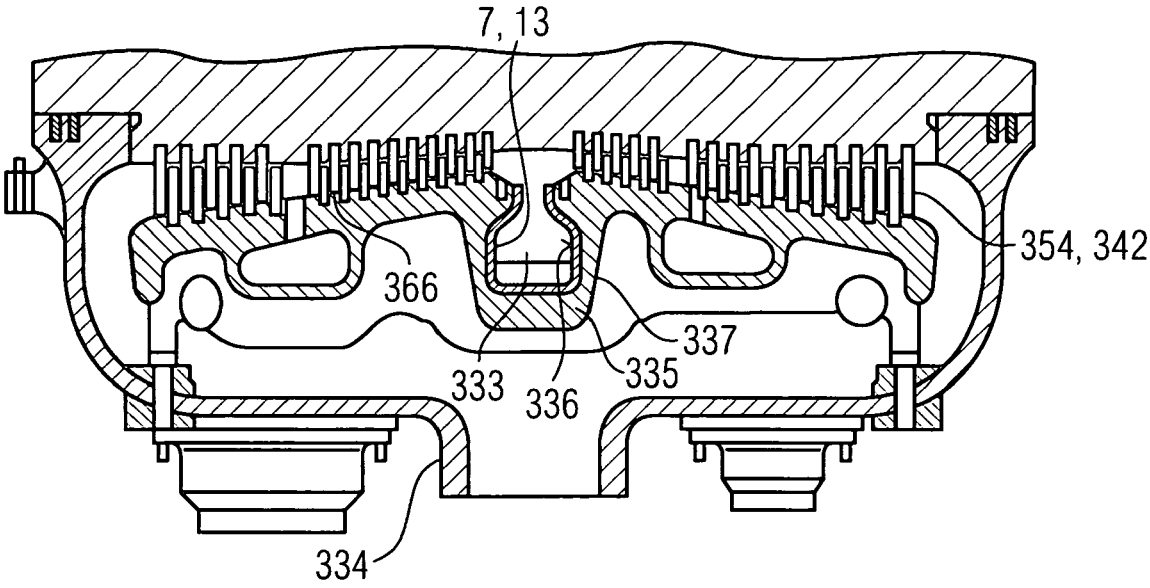

FIG. 5 shows an enlarged illustration of a region of the steam turbine 300, 303.

In the region of the inflow region 333, the steam turbine 300, 303 comprises an outer housing 334, which is exposed to temperatures of between 250° and 350° C.

Temperatures of from 450° to 800° C. are present at the inflow region 333 as part of an inner housing 335.

This results in a temperature difference of at least 200° C.

At the inner housing 335, which is exposed to the high temperatures, the thermal barrier coating 7, together with the erosion-resistant layer 13, is applied to the inner side 336 (for example not to the outer side 337).

The thermal barrier coating 7 is locally present only at the inner housing 335 (and for example not in the blading region 366).

The application of a thermal barrier coating 7 with the erosion-resistant layer 13 reduces the introduction of heat into the inner housing 335, with the result that the thermal expansion properties are influenced. As a result, all the deformation properties of the inner housing 335 and the steam inflow region 333 can be set in a controlled way.

This can be achieved by varying the thickness of the thermal barrier coating 7 or applying different materials at different locations of the surface of the inner housing 335.

It is also possible for the porosity to be different at different locations of the inner housing 335.

The thermal barrier coating 7 can be applied locally, for example in the inner housing 335 in the region of the inflow region 333.

Figure 6:
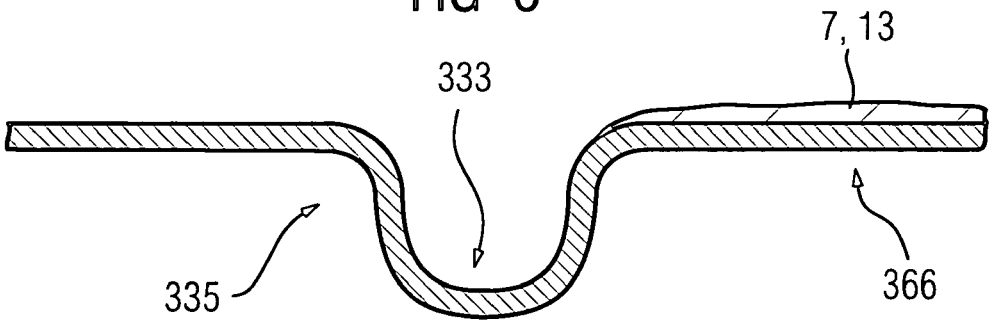
FIGS. 6, 7, 8 show further exemplary embodiments of a component formed in accordance with the invention.

It is also possible for the thermal barrier coating 7 to be applied locally only in the blading region 366 (FIG. 6).

The use of an erosion-resistant layer 13 is required in particular in the inflow region 333.

If the thermal barrier coating 7 (TBC) with erosion-resistant layer 13 is present in the inflow region 333, a thermal barrier coating 7 without erosion-resistant layer may be present in the blading region 366 and/or the turbine blades or vanes.

| | Inflow region | Blading region | Turbine blade or vane |
|---|---|---|---|
| TBC | Yes + 13 | No | No |
| TBC | Yes + 13 | Yes | No |
| TBC | Yes + 13 | No | Yes |
| TBC | Yes + 13 | Yes + 13 | No |
| TBC | Yes | Yes + 13 | No |
| TBC | Yes | No | Yes + 13 |

Figure 7:
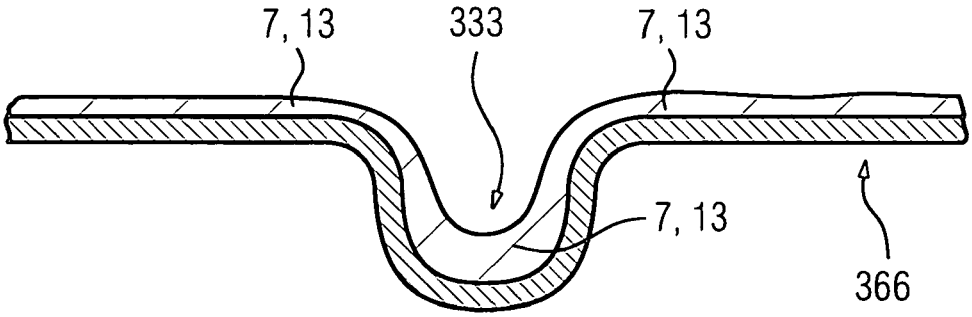

FIG. 7 shows a further exemplary embodiment of a component 1 according to the invention.

In this case, the thickness of the thermal barrier coating 7 is configured to be thicker in the inflow region 333 than in the blading region 366 of the steam turbine 300, 303.

The locally differing thickness of the thermal barrier coating 7 is used for controlled setting of the introduction of heat and therefore the thermal expansion and consequently the expansion properties of the inner housing 334, comprising the inflow region 333 and the blading region 366.

Since higher temperatures are present in the inflow region 333 than in the blading region 366, the thicker thermal barrier coating 7 in the inflow region 333 reduces the introduction of heat into the substrate 4 to a greater extent than in the blading region 366, where the temperatures are lower. Therefore, the introduction of heat can be kept at approximately equal levels in the inflow region 333 and the adjoining blading region 366, resulting in an approximately equal thermal expansion.

It is also possible for a different material to be used in the region of the inflow region 333 than in the blading region 366. Here, the thermal barrier coating 7 is applied throughout the entire hot zone, i.e. everywhere, and includes the erosion-resistant layer 13.

Figure 8:
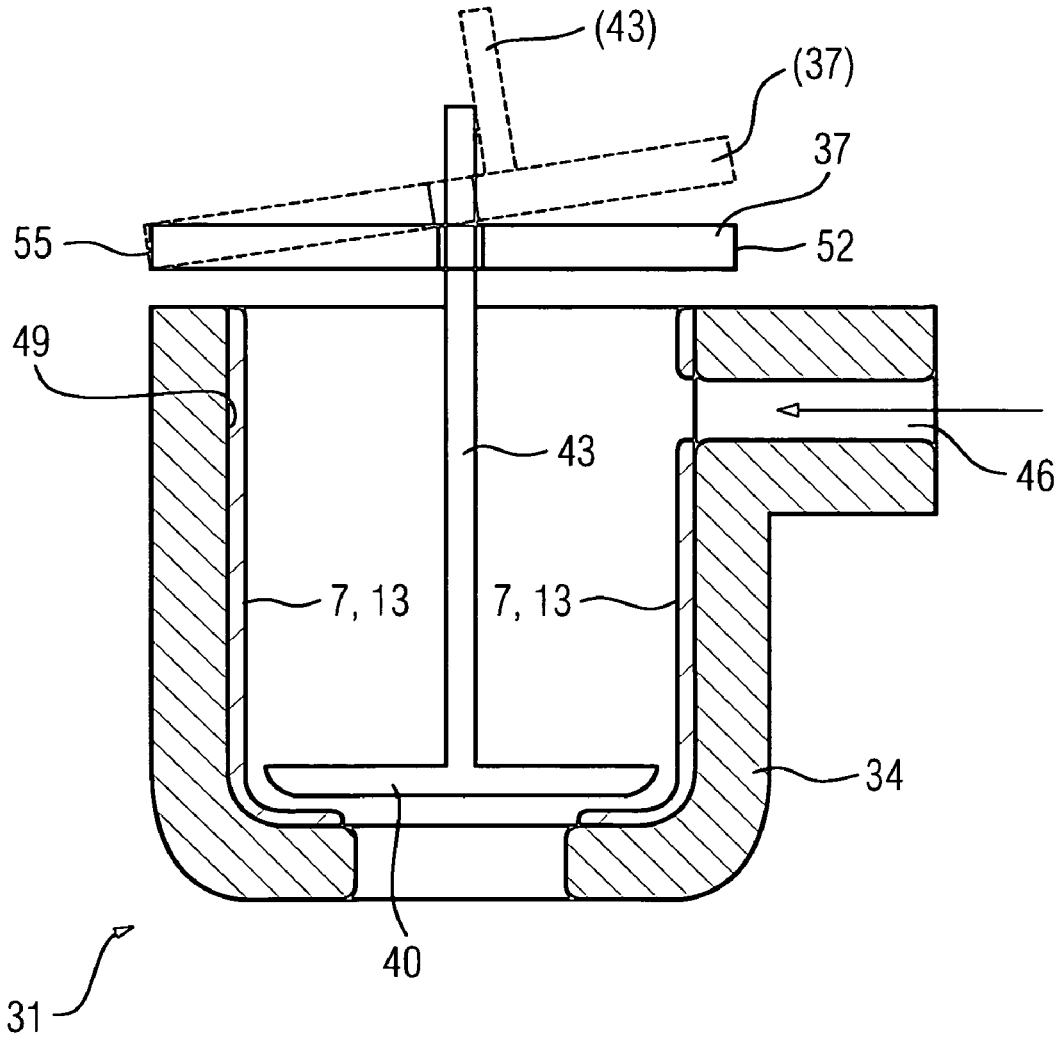

FIG. 8 shows another application example for the use of a thermal barrier coating 7.

The component 1, in particular a housing part, is in this case a valve housing 31, into which a hot steam flows through an inflow passage 46.

The inflow passage 46 mechanically weakens the valve housing.

The valve housing 31 comprises, for example, a pot-shaped housing part 34 and a cover 37.

Inside the housing part 31 there is a valve comprising a valve cone 40 and a spindle 43.

Component creep leads to uneven axial deformation of the housing 31 and cover 37. The valve housing 31 would expand to a greater extent in the axial direction in the region of the passage 46, leading to tilting of the cover together with the spindle 43, as indicated by dashed lines. As a result, the valve cone 34 is no longer seated correctly, which reduces the leak tightness of the valve.

The application of a thermal barrier coating 7 to an inner side 49 of the housing 31 makes the deformation properties more uniform, so that both ends 52, 55 of the housing 31 and of the cover 37 expand evenly.

Overall, the application of the thermal barrier coating 7 serves to control the deformation properties and therefore to ensure the leak tightness of the valve.

The thermal barrier coating 7 once again includes the erosion-resistant layer 13.

The invention claimed is:

1. A layer system for a component, comprising:

a substrate;

a metallic bonding layer, an erosion-resistant layer; wherein the metallic bonding layer is selected from the group consisting of:

9%-31% nickel (in wt %),
27%-29% chromium (in wt %),
7%-8% aluminum (in wt %),
0.5%-0.7% yttrium (in wt %),
0.3%-0.7% silicon (in wt %),
remainder cobalt,
11%-13% cobalt (in wt %),
20%-22% chromium (in wt %),
10.5%-11.5% aluminum (in wt %),
0.3%-0.5% yttrium (in wt %),
1.5%-2.5% rhenium (in wt %),
remainder nickel,
24%-26% cobalt (in wt %),
16%-18% chromium (in wt %),
9.5%-11% aluminum (in wt %),
0.3%-0.5% yttrium (in wt %),
1.0%-1.8% rhenium (in wt %),
remainder nickel,
11.5%-20% chromium (in wt %),
0.3%-1.5% silicon (in wt %),
0%-1% aluminum (in wt %),
0%-4% yttrium (in wt %),
remainder iron, and
12.5%-14% chromium (in wt %),
0.5%-1.0% silicon (in wt %),
0.1%-0.5% aluminum (in wt %),
0%-4% yttrium (in wt %),
remainder iron, wherein the bonding layer and the erosion-resistant layer have a similar composition;

a thermal barrier coating on the metallic bonding layer; and an outer metallic erosion-resistant layer on the thermal barrier coating.

2. The layer system as claimed in claim 1, wherein the bonding layer and the erosion-resistant layer have an identical composition.

3. The layer system as claimed in claim 1, wherein the component is a component of a steam turbine.

4. The layer system as claimed in claim 1, wherein the thermal barrier coating is a ceramic thermal barrier coating.

5. The layer system as claimed in claim 1, wherein the material of the bonding layer and of the erosion-resistant layer is an MCrAlX alloy.

6. The layer system as claimed in claim 1, wherein the erosion-resistant layer and the bonding layer consist of an alloy selected from the group consisting of an iron-base alloy, a nickel-base alloy, a chromium-base alloy, a cobalt-base alloy, and NiCr80/20.

7. The layer system as claimed in claim 1, wherein the erosion-resistant layer and the bonding layer consist of a nickel-chromium alloy with an admixture or of a nickel-aluminum alloy, wherein the admixture is selected from the group consisting of silicon, boron and a combination thereof.

8. The layer system as claimed in claim 1, wherein the erosion-resistant layer has a lower porosity than the thermal barrier coating, and wherein a difference in density is at least 1%.

9. The layer system as claimed in claim 1, wherein the erosion-resistant layer has a density of at least 96% of the theoretical density of the erosion-resistant layer.

10. The layer system as claimed in claim 1, wherein the density of the thermal barrier coating is 80-95% of the theoretical density of the thermal barrier coating, and wherein the thermal barrier coating is at least partially porous.

11. The layer system as claimed in claim 10, wherein the thermal barrier coating has a porosity gradient.

12. The layer system as claimed in claim 1, wherein the material of the metallic erosion-resistant layer has a high ductility, and wherein the material of the metallic erosion-resistant layer has an elongation at break of 5%.

13. The layer system as claimed in claim 1, wherein the layer system is a housing part of a gas or steam turbine.

14. The layer system as claimed in claim 1, wherein the layer system is a turbine blade or vane.

15. The layer system as claimed in claim 1, wherein the erosion-resistant layer is present on the component where the angle at which eroding particles impinge on the component is between 60°-120°, and wherein the thermal barrier coating is selected from the group consisting of zirconium oxide and titanium oxide.

16. The layer system as claimed in claim 1, wherein the layer system is applied in the inflow region and in the bladed region of a steam turbine.

17. The layer system as claimed in claim 1, wherein the bonding layer, the thermal barrier coating and the erosion-resistant layer are applied to refurbished components.

18. A method for producing a component with a layer system, comprising providing a substrate;

providing a metallic bonding layer, an erosion-resistant layer; wherein the metallic bonding layer is selected from the group consisting of:

9%-31% nickel (in wt %),
27%-29% chromium (in wt %),
7%-8% aluminum (in wt %),
0.5%-0.7% yttrium (in wt %),
0.3%-0.7% silicon (in wt %),
remainder cobalt,
11%-13% cobalt (in wt %),
20%-22% chromium (in wt %),
10.5%-11.5% aluminum (in wt %),
0.3%-0.5% yttrium (in wt %),
1.5%-2.5% rhenium (in wt %),
remainder nickel,
24%-26% cobalt (in wt %),
16%-18% chromium (in wt %),
9.5%-11% aluminum (in wt %),
0.3%-0.5% yttrium (in wt %),
1.0%-1.8% rhenium (in wt %),
remainder nickel,
11.5%-20% chromium (in wt %),
0.3%-1.5% silicon (in wt %),
0%-1% aluminum (in wt %),
0%-4% yttrium (in wt %),
remainder iron, and
12.5%-14% chromium (in wt %),
0.5%-1.0% silicon (in wt %),
0.1%-0.5% aluminum (in wt %),
0%-4% yttrium (in wt %),
remainder iron, wherein the bonding layer and the erosion-resistant layer have a similar composition, a thermal barrier coating on the metallic bonding layer, and an outer metallic erosion-resistant layer on the thermal barrier coating; and densifying the erosion-resistant layer after application to the thermal barrier coating.

19. A method for operating a steam turbine, comprising:

providing a steam containing eroding particles flowing within the steam turbine, wherein the eroding particles impinge on inner surfaces of the steam turbine at an angle of 60°-120°, and wherein at least the inner surfaces of the steam turbine have a layer system having:

a substrate, a metallic bonding layer, an erosion-resistant layer; wherein the metallic bonding layer is selected from the group consisting of:

9%-31% nickel (in wt %),
27%-29% chromium (in wt %),
7%-8% aluminum (in wt %),
0.5%-0.7% yttrium (in wt %),
0.3%-0.7% silicon (in wt %),
remainder cobalt,
11%-13% cobalt (in wt %),
20%-22% chromium (in wt %),
10.5%-11.5% aluminum (in wt %),
0.3%-0.5% yttrium (in wt %),
1.5%-2.5% rhenium (in wt %),
remainder nickel,
24%-26% cobalt (in wt %),
16%-18% chromium (in wt %),
9.5%-11% aluminum (in wt %),
0.3%-0.5% yttrium (in wt %),
1.0%-1.8% rhenium (in wt %),
remainder nickel,
11.5%-20% chromium (in wt %),
0.3%-1.5% silicon (in wt %),
0%-1% aluminum (in wt %),
0%-4% yttrium (in wt %),
remainder iron, and
12.5%-14% chromium (in wt %),
0.5%-1.0% silicon (in wt %),
0.1%-0.5% aluminum (in wt %),
0%-4% yttrium (in wt %),
remainder iron, wherein the bonding layer and the erosion-resistant layer have a similar composition, a thermal barrier coating on the metallic bonding layer, and an outer metallic erosion-resistant layer on the thermal barrier coating.

20. The method as claimed in claim 19, wherein the inner surfaces of the steam turbine are provided with a layer system on which the particles impinge at an angle of 80°-100°.

* * * * *